US011739772B2

(12) United States Patent
Thornber et al.

(10) Patent No.: US 11,739,772 B2
(45) Date of Patent: Aug. 29, 2023

(54) REDUNDANT VALVE MANIFOLD SYSTEM

(71) Applicant: ROSS OPERATING VALVE COMPANY, Troy, MI (US)

(72) Inventors: Thomas Peter Thornber, Darwen (GB); Christopher John Perkins, Clitheroe (GB)

(73) Assignee: Ross Operating Valve Company, Ferndale, MI (US)

( * ) Notice: Subject to any disclaimer, the term of this patent is extended or adjusted under 35 U.S.C. 154(b) by 0 days.

(21) Appl. No.: 17/324,580

(22) Filed: May 19, 2021

(65) Prior Publication Data

US 2021/0364017 A1 Nov. 25, 2021

Related U.S. Application Data

(60) Provisional application No. 63/027,616, filed on May 20, 2020.

(51) Int. Cl.

*F15B 20/00* (2006.01)
*F15B 13/02* (2006.01)
*F15B 19/00* (2006.01)

(52) U.S. Cl.

CPC ..... *F15B 20/008* (2013.01); *F15B 13/028* (2013.01); *F15B 19/005* (2013.01);
(Continued)

(58) Field of Classification Search

CPC ..... Y10T 137/2562; Y10T 137/7839; F15B 20/008; F15B 13/028; F15B 19/005;
(Continued)

(56) References Cited

U.S. PATENT DOCUMENTS 1,383,306 A * 7/1921 Jacques ..... F16N 21/04 184/105.3
2,065,087 A * 12/1936 May ..... G05D 16/12 137/454.5

(Continued)

FOREIGN PATENT DOCUMENTS

CN 104976168 10/2015
GB 2574272 12/2019

(Continued)

OTHER PUBLICATIONS

International Search Report and Written Opinion for International Patent Application No. PCT/US2021/033118 dated Aug. 26, 2021.

(Continued)

*Primary Examiner* — William M McCalister
(74) *Attorney, Agent, or Firm* — Carlson, Gaskey & Olds, P.C.

(57) ABSTRACT

A redundant valve manifold system includes at least two automatic valves coupled to one another and at least two automatic isolation valves each corresponding to one of the at least two automatic valves. Each of at least two automatic isolation valves is operatively coupled to one of the at least two automatic valves and isolates the one of the at least two automatic valves when the one of the at least two automatic valves is removed from the system to deliver media to an outlet.

16 Claims, 5 Drawing Sheets

(52) U.S. Cl.
CPC ... *F15B 2211/8636* (2013.01); *F15B 2211/87* (2013.01); *F15B 2211/8757* (2013.01)

(58) Field of Classification Search
CPC ..... F15B 2211/8636; F15B 2211/87; F15B 2211/8757
USPC ..... 137/110, 512.1
See application file for complete search history.

(56) References Cited

U.S. PATENT DOCUMENTS

| | | | | | |
|---|---|---|---|---|---|
| 2,434,167 | A * | 1/1948 | Knoblauch | F16L 37/23 | 251/149.6 |
| 3,104,088 | A * | 9/1963 | Cator | F16L 37/23 | 251/149.6 |
| 4,848,393 | A * | 7/1989 | West | F16K 11/0856 | 137/884 |
| 5,575,767 | A * | 11/1996 | Stevens | A61M 5/007 | 251/149.6 |
| 6,990,991 | B2 * | 1/2006 | Meckes | B64D 13/00 | 137/505.11 |
| 7,828,008 | B1 * | 11/2010 | Beckman | F16K 37/0091 | 251/26 |
| 7,909,064 | B2 * | 3/2011 | Natili, Jr. | F16L 39/00 | 251/149.6 |
| 9,664,299 | B2 * | 5/2017 | Maier | G05D 7/0641 | |
| 10,400,905 | B2 * | 9/2019 | Swagten | E21B 19/006 | |
| 2006/0230755 | A1 * | 10/2006 | Natili, Jr. | F01D 21/20 | 60/468 |
| 2010/0116368 | A1 * | 5/2010 | Khoshnevis | G01F 3/14 | 137/613 |

FOREIGN PATENT DOCUMENTS

| | | |
|---|---|---|
| WO | 2015155786 | 10/2015 |
| WO | 2021059019 | 4/2021 |

OTHER PUBLICATIONS

International Preliminary Report on Patentability for International Patent Application No. PCT/US2021/033118 dated Dec. 1, 2022.

* cited by examiner

REDUNDANT VALVE MANIFOLD SYSTEM

PRIORITY

This application claims the benefit of U.S. Provisional Application No. 63/027,616 filed May 20, 2020, the disclosures of which are incorporated entirely by reference.

BACKGROUND

A redundant valve manifold (RVM) system is used in a processing and manufacturing industry. An RVM system is employed in an industrial process to provide a heightened level of redundancy and/or availability in safety critical operation. An RVM system includes valves that operate in series to provide safety and in parallel to provide availability.

SUMMARY

Embodiments of a redundant valve manifold system are disclosed herein. The redundant valve manifold system includes at least two automatic valves coupled to one another and at least two automatic isolation valves each corresponding to one of the at least two automatic valves. Each of at least two automatic isolation valves is operatively coupled to one of the at least two automatic valves and isolates the one of the at least two automatic valves when the one of the at least two automatic valves is removed from the system to deliver media to an outlet.

In an embodiment, one of the at least two automatic valves or one of the at least two automatic isolation valves includes a pin including a pin opening, the pin defining a pin fluid passage in fluid communication with the pin opening and that is received in a valve seat passage of a valve seat, and the other of the one of the at least two automatic valves or the one of the at least two automatic isolation valves includes a ball and a resilient member that are received in a ball fluid passage that is in fluid communication with the pin fluid passage. When the one of the at least two automatic valves is installed in the system, the pin contacts the ball to compress the resilient member and push the ball away from the valve seat, and the pin fluid passage and the pin openings are in fluid communication with the valve fluid passage to allow the media to flow through the valve fluid passage, the pin openings in the pin, and the pin fluid passage of the pin.

In an embodiment, if one of the at least two automatic valves fails and is removed from the system, the associated one of the automatic isolation valves automatically actuates. As the pin is removed from the valve seat passage of the valve seat, the resilient member biases the ball towards the valve seat, blocking the flow of the media through the valve seat passage to isolate the one of the at least two automatic valves from service to allow for replacement.

In an embodiment, the system includes at least two indicators each associated with one of the at least two automatic valves, wherein each of the at least two indicators indicate if the associated automatic valve has failed.

In an embodiment, each of the at least two indicators are visual indicators.

In an embodiment, each of the at least two indicators are pressure sensors or pressure switches.

In an embodiment, the system includes another indicator and yet another indicator, and an inlet is associated with the another indicator, and the outlet is associated with the yet another indicator.

In an embodiment, the system includes a first shuttle valve associated with one of the at least two automatic valves and the outlet.

In an embodiment, the system includes a second shuttle valve associated with the other of at least two automatic valves.

In an embodiment, when the at least two automatic valves are in the energized state, the media is able to flow through the system and to the outlet, and when all the at least two automatic valves are in the de-energized state, the media is unable to flow through the system and to the outlet, and some media flows to an exhaust.

In an embodiment, the at least two automatic valves comprise a first automatic valve, a second automatic valve, a third automatic valve, and a fourth automatic valve that can each be in an energized state or a de-energized state. The at least two automatic isolation valves comprise a first automatic isolation valve, a second automatic isolation valve, a third automatic isolation valve, and a fourth automatic isolation valve, respectively.

In an embodiment, the system receives three input signals comprising a first input signal, a second input signal, and a third input signal, wherein the first automatic valve and the second automatic valve together receive the first input signal, the third automatic valve receives the second input signal, and the fourth automatic valve receives the third input signal. Two out of the three input signals are required to maintain an output at the outlet.

In an embodiment, the system receives four input signals comprising a first input signal, a second input signal, a third input signal, and a fourth input signal, wherein the first automatic valve receives the first input signal, the second automatic valve receives the second input signal, the third automatic valve receives the third input signal, and the fourth automatic valve receives the fourth input signal. Three out of the four input signals are required to maintain an output at the outlet.

In an embodiment, the at least two automatic valves comprise a first automatic valve and a second automatic valve that can each be in an energized state or a de-energized state, and the at least two automatic isolation valves comprise a first automatic isolation valve and a second automatic isolation valve, respectively.

In an embodiment, the system receives two input signals comprising a first input signal and a second input signal, wherein the first automatic valve receives the first input signal and the second automatic valve receives the second input signal. Two out of two input signals are required to maintain an output at the outlet.

In an embodiment, the system receives two input signals comprising a first input signal and a second input signal, wherein the first automatic valve receives the first input signal and the second automatic valve receives the second input signal. One out of two input signals are required to maintain an output at the outlet.

In an embodiment, the automatic valves are connected in a series configuration, and an output of the first automatic valve is a sole input of the second automatic valve.

In another exemplary embodiment, a redundant valve manifold system includes at least two automatic valves coupled to one another and at least two automatic isolation valves each corresponding to one of the at least two automatic valves. Each of at least two automatic isolation valves is operatively coupled to one of the at least two automatic valves and isolates the one of the at least two automatic valves when the one of the at least two automatic valves is removed from the system to deliver media to an outlet. The system includes a first shuttle valve associated with one of the at least two automatic valves and the outlet and a second shuttle valve associated with the other of at least two automatic valves. The system includes at least two visual indicators, another visual indicator, and yet another visual indicator. Each of the at least two visual indicators is associated with one of the at least two automatic valves, and each of the at least two visual indicators indicate if the associated automatic valve has failed. An inlet is associated with the another visual indicator, and the outlet is associated with the yet another visual indicator. One of the at least two automatic valves or one of the at least two automatic isolation valves includes a pin including a pin opening, the pin defining a pin fluid passage in fluid communication with the pin opening and that is received in a valve seat passage of a valve seat, and the other of the one of the at least two automatic valves or the one of the at least two automatic isolation valves includes a ball and a resilient member that are received in a ball fluid passage that is in fluid communication with the pin fluid passage. When the one of the at least two automatic valves is installed in the system, the pin contacts the ball to compress the resilient member and push the ball away from the valve seat, and the pin fluid passage and the pin openings are in fluid communication with the valve fluid passage to allow the media to flow through the valve fluid passage, the pin openings in the pin, and the pin fluid passage of the pin. If one of the at least two automatic valves fails and is removed from the system, the associated one of the automatic isolation valves automatically actuates. As the pin is removed from the valve seat passage of the valve seat, the resilient member biases the ball towards the valve seat, blocking the flow of the media through the valve seat passage to isolate the one of the at least two automatic valves from service to allow for replacement.

DETAILED DESCRIPTION

Figure 1:
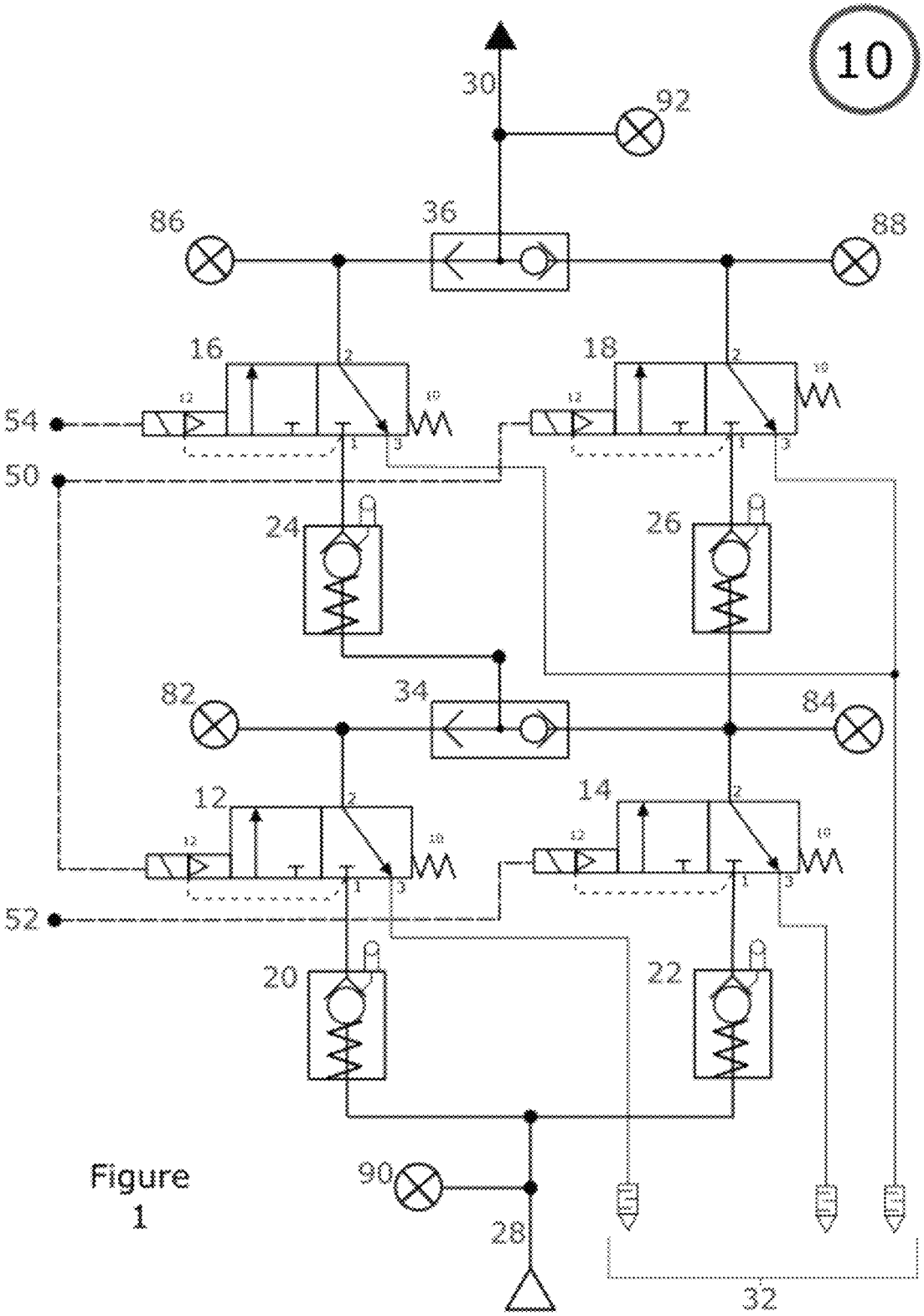
FIG. 1 illustrates a circuit diagram of a redundant valve manifold (RVM) system operating with a two out of three (2oo3) function.

FIG. 1 illustrates a circuit diagram of a redundant valve manifold (RVM) system 10 used in a processing and manufacturing industry operating with a 2oo3 function. The RVM system 10 includes four automatic valves 12, 14, 16, and 18 that can each be in an energized state or a de-energized state. The automatic valves 12, 14, 16, and 18 control a flow of media, such as air, from an inlet 28 to an outlet 30. When the automatic valves 12, 14, 16, and 18 are in an energized state, the RVM system 10 delivers the media to the outlet 30. When the automatic valves 12, 14, 16, and 18 are in the de-energized state, the media is unable to flow through the RVM system 10, and some of the exhaust media in the RVM system 10 is vented to the exhaust 32.

Each automatic valve 12, 14, 16, and 18 is a 3/2 automatic valve having 3 ports and 2 positions and is used to control a flow of the media through the RVM system 10. In one example, the media can be air. In one example, the automatic valves 12, 14, 16, and 18 are solenoid valves. The automatic valves 12, 14, 16, and 18 are generally arranged in a series redundancy and a parallel redundancy. Redundancy means that a failure of a single valve does not stop normal operation of the RVM system 10 because there is a redundant valve to perform the required function and maintain the normal operation of the RVM system 10. Redundant systems such as the RVM system 10 increase uptime of the larger safety instrumented system by ensuring the continuous running of the RVM system 10 in the event of failure of one of the inputs, such as the automatic valves 12, 14, 16, and 18 (availability) or sensors. Redundant systems also increase safety by ensuring the RVM system 10 can be shut down in the event of a failure.

Figure 2A:
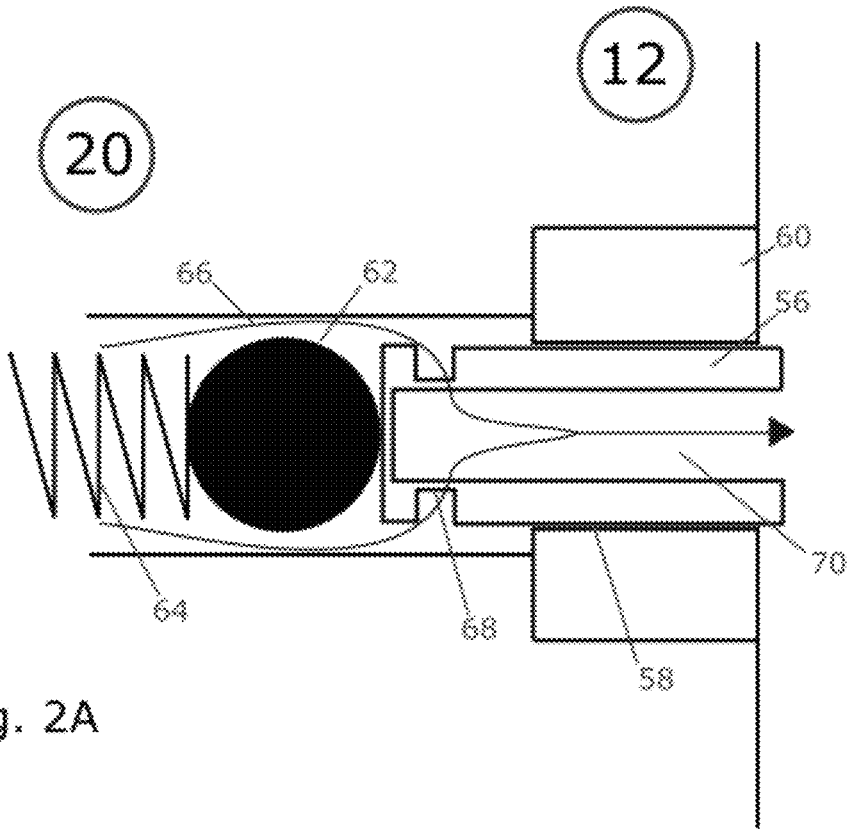
FIG. 2A illustrates an automatic isolation valve when installed in the RVM system.
Figure 2B:
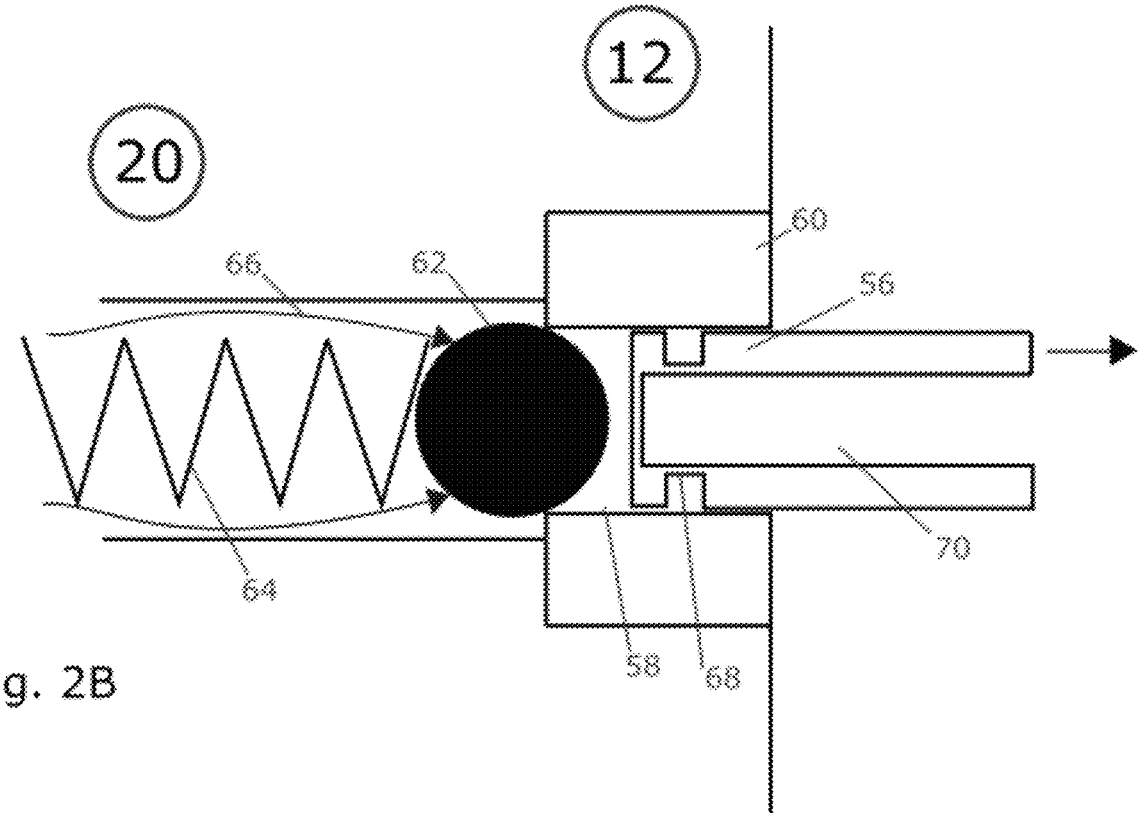
FIG. 2B illustrates the automatic isolation valve when removed from the RVM system.

An automatic isolation valve 20, 22, 24, and 26 is coupled to each of the automatic valves 12, 14, 16, and 18, respectively, to allow the automatic valves 12, 14, 16, and 18 to be hot swapped. In one example, the automatic isolation valves 20, 22, 24, and 26 are reverse check valves, as shown in FIGS. 2A and 2B, discussed below. Although the automatic isolation valve 20 is illustrated and described, the other automatic isolation valves 22, 24, and 26 include the same features.

The automatic isolation valves 20, 22, 24, and 26 allow the automatic valves 12, 14, 16, and 18, respectively, to be isolated from service. Hot swapping is an operation to replace elements of the RVM system 10 without shutting down or bypassing the entire RVM system 10. Hot swapping allows one of the automatic valves 12, 14, 16, and 18 to be isolated from service and repaired, replaced, and reintroduced into the RVM system 10 while the remainder of the automatic valves 12, 14, 16, and 18 remain in service. Each integrated isolation valve 20, 22, 24, and 26 isolates the corresponding automatic valves 12, 14, 16, and 18 with which it is operatively coupled by physically removing the corresponding automatic valves 12, 14, 16, and 18 from the RVM system 10.

FIG. 2A shows the automatic valve 12 and the automatic isolation valve 20 installed in the RVM system 10. The automatic valve 12 includes a pin 56 defining a fluid passage 70 that is received in a passage 58 of a valve seat 60. The automatic isolation valve 20 includes a ball 62 and a resilient member 64, such as a spring, that are received in another fluid passage 66 that is in fluid communication with the fluid passage 70 of the automatic valve 12 when installed. When the automatic valve 12 is installed in the RVM system 10, the pin 56 of the automatic valve 12 contacts the ball 62, compressing the resilient member 64 and pushing the ball 62 away from the valve seat 60. The pin 56 includes openings 68 that are in fluid communication with the fluid passage 66, allowing the media to flow through the fluid passage 66, through the openings 68 in the pin 56, and through the fluid passage 70 in the pin 56 of the automatic valve 12. The physical installation of the automatic valve 12 into the RVM system 10 pushes the ball 62 away from the valve seat 60, allowing the media to flow into the automatic valve 12. Although an automatic valve 12 including a pin 56 and an automatic isolation valve including a ball and a resilient member have been illustrated and described, it is to be understood that the features can be reversed. The automatic isolation valve 20 can include a pin 56, and the automatic valve 12 can include a ball and a resilient member If the automatic valve 12 fails and is removed as shown in FIG. 2B, and the automatic isolation valve 20 automatically actuates. As the pin 56 of the automatic valve 12 is removed from the passage 58, the resilient member 64 biases the ball 62 towards the valve seat 60, blocking the flow of the media through the passage 58, and isolating the automatic valve 12 from service.

During normal operation of the RVM system 10, a ball 62 of each of the automatic isolation valves 20, 22, 24, and 26 is pushed away from the valve seat 60 by the pin 56 of the automatic valve 12, 14, 16, and 18, respectively, to allow the media to flow through the automatic isolation valve 20, 22, 24, and 26, respectively, and through the automatic valves 12, 14, 16, and 18, respectively. If one of the automatic valves 12, 14, 16, and 18 is manually removed from the RVM system 10, the pin 56 of the automatic valve 12, 14, 16, and 18, respectively, is also removed from the valve seat 62. The ball 62 of the automatic isolation valve 20, 22, 24, and 26, respectively, is biased by the resilient member 64 towards the valve seat 60, and the flow of the media through the respective automatic valve 12, 14, 16, and 18 is automatically blocked by the ball 62. That is, by removing one of the automatic valves 12, 14, 16, and 18, the automatic isolation valve 20, 22, 24, and 26, respectively, isolates or blocks flow of the media through the automatic valves 12, 14, 16, and 18, respectively, Although the automatic valves 12 and the automatic isolation valve 20 are illustrated and described, the automatic valves 14, 16, and 18 and the automatic isolation valves 22, 24, and 26, respectively, operate in the same manner.

The RVM system 10 receives three input signals 50, 52, and 54. In one example, the three input signals 50, 52, and 54 are electrical. In one example, the automatic valves 12 and 18 together receive the input signal 50, the automatic valve 14 receives the input signal 52, and the automatic valve 16 receives the input signal 54. Two out of the three input signals 50, 52, and 54 are required to maintain an output at the outlet 30. If two out of the three input signals 50, 52, and 54 are de-energized, the output at the outlet 30 is prevented.

In one example, the RVM system 10 also includes two shuttle valves 34 and 36. The first shuttle valve 34 is associated with the automatic valves 12 and 14, and the second shuttle valve 36 is associated with the automatic valves 16 and 18. The second shuttle valve 36 is also associated with the outlet 30. In another example, the RVM system 10 does not include the shuttle valves.

In one example, the RVM system 10 includes indicators 82, 84, 86, and 88 that each indicate if the corresponding automatic valve 12, 14, 16, and 18, respectively, has failed and allow for diagnosis of an error. In one example, the indicators 82, 84, 86, and 88 are visual indicators. In other examples, the indicators 82, 84, 86, and 88 are pressure sensors or pressure switches or other types of sensors to indicate a fault or error. The inlet 28 is associated with an indicator 90, and the outlet 30 is associated with an indicator 92.

When all the automatic valves 12, 14, 16, and 18 are in the energized state, the media is able to flow through the RVM system 10 and to the outlet 30. When all the automatic valves 12, 14, 16, and 18 are in the de-energized state, the media is unable to flow through the RVM system 10 to the outlet 30, and some of the media flows to the exhaust 32.

If one of the automatic valves 12, 14, 16, and 18 fail, the RVM system 10 will continue to function to produce an output at the outlet 30.

In one example of a single valve failure, the automatic valve 12 is de-energized, and the automatic valves 14, 16, and 18 are energized. The media passes through the energized automatic valve 14, the first shuttle valve 34, the energized automatic valves 16 and 18, and flows through the outlet 30. The indicators 84, 86 and 88 indicate availability, and the indicator 82 indicates unavailability. The automatic valve 12 is removed, and the automatic isolation valve 20 associated with the automatic valve 12 is automatically activated by the removal of the automatic valve 12 to perform hot swapping. During this time, the automatic valves 14, 16, and 18 of the RVM system 10 continue to function to produce an output at the outlet 30.

In another example of a single valve failure, the automatic valve 16 is de-energized, and the automatic valves 12, 14 and 18 are energized. The media passes through the energized automatic valves 12 and 14, the first shuttle valve 34, the automatic valve 18, the second shuttle valve 36, and flows through the outlet 30. The indicators 82, 84, 88 indicate availability, and the indicator 86 indicates unavailability. The automatic valve 16 is removed, and the automatic isolation valve 24 associated with the automatic valve 16 is automatically activated by the removal of the automatic valve 16 to perform hot swapping. During this time, the automatic valves 12, 14, and 18 of the RVM system 10 continue to function to produce an output at the outlet 30.

In another example of a single valve failure, the automatic valve 18 is de-energized, and the automatic valves 12, 14, and 16 are energized. The media passes through the automatic valves 12 and 14, the first shuttle valve 34, the automatic valve 16, and the second shuttle valve 36, and flows through the outlet 30. The indicators 82, 84, 86 indicate availability, and the indicator 88 indicates unavailability. The automatic valve 18 is removed, and the automatic isolation valve 26 associated with the automatic valve 18 is automatically activated by the removal of the automatic valve 18 to perform hot swapping. During this time, the automatic valves 12, 14, and 16 of the RVM system 10 continue to function to produce an output at the outlet 30.

In another example, the automatic valve 14 is de-energized, and the automatic valves 12, 16, and 18 are energized. The media passes through the energized automatic valve 12, the first shuttle valve 34, the energized automatic valve 16, the second shuttle valve 36, and flows through the outlet 30. The indicators 82 and 86 indicate availability, and the indicators 84 and 88 indicate unavailability. The automatic valve 14 is removed, and the automatic isolation valve 22 associated with the automatic valve 14 is automatically activated by the removal of the automatic valve 14 to perform hot swapping. During this time, the automatic valves 12 and 16 of the RVM system 10 continue to function to produce an output at the outlet 30. Although the automatic valve 18 is not faulty, the automatic valve 18 does not function due to the absence of a media supply from the automatic valve 14. Further diagnostic trouble shooting is employed to confirm that the automatic valve 14 is de-energized before the automatic valve 14 is replaced.

In an example of a two valve failure, the automatic valves 12 and 16 are de-energized, and the automatic valves 14 and 18 are energized. The media passes through the energized automatic valves 14 and 18, the second shuttle valve 36, and flows through the outlet 30. The indicators 84 and 88 indicate availability, and indicators 82 and 86 indicate unavailability. The automatic valves 12 and 16 are removed, and the automatic isolation valves 20 and 24, respectively, associated with the automatic valves 12 and 16 are automatically activated by the removal of the automatic valves 12 and 16 to perform hot swapping. During this time, the RVM system 10 continues to function to produce an output at the outlet 30.

In another example of a two valve failure, the automatic valves 14 and 18 are de-energized, and the automatic valves 12 and 16 are energized. The media passes through the energized automatic valve 12, the first shuttle valve 34, the energized automatic valve 16, the second shuttle valve 36, and flows through the outlet 30. The indicators 82 and 86 indicate availability, and the indicators 84 and 88 indicate unavailability. The automatic valves 14 and 18 are removed, and the automatic isolation valves 22 and 26, respectively, associated with the automatic valves 14 and 18 are automatically activated by the removal of the automatic valves 14 and 18 to perform hot swapping. During this time, the RVM system 10 continues to function to produce an output at the outlet 30.

In another example of a two valve failure, the automatic valves 12 and 18 are de-energized, and the automatic valves 14 and 16 are energized. The media passes through the automatic valve 14, the first shuttle valve 34, the automatic valve 16, the second shuttle valve 36, and flows through the outlet 30. The indicators 84 and 86 indicate availability, and the indicators 82 and 88 indicate unavailability. The automatic valves 12 and 18 are removed, and the automatic isolation valves 20 and 26, respectively, associated with the automatic valves 12 and 18 are automatically activated by the removal of the automatic valves 12 and 18 to perform hot swapping. During this time, the RVM system 10 continues to function to produce an output at the outlet 30.

In some examples of a two valve failure or a three valve failure, the media is unable to flow through the outlet 30. This can occur when the automatic valve 12 is energized and the automatic valves 14, 16, and 18 are de-energized, the automatic valve 14 is energized and the automatic valves 12, 16, and 18 are de-energized, the automatic valve 16 is energized and the automatic valves 12, 14, and 18 are de-energized, and the automatic valve 18 is energized and the automatic valves 12, 14, and 16 are de-energized. This can also occur when the automatic valves 12 and 14 are energized and the automatic valves 16 and 18 are de-energized, the automatic valves 16 and 18 are energized and the automatic valves 12 and 14 are de-energized, and the automatic valves 14 and 16 are de-energized, and the automatic valves 12 and 18 are energized.

Figure 3:
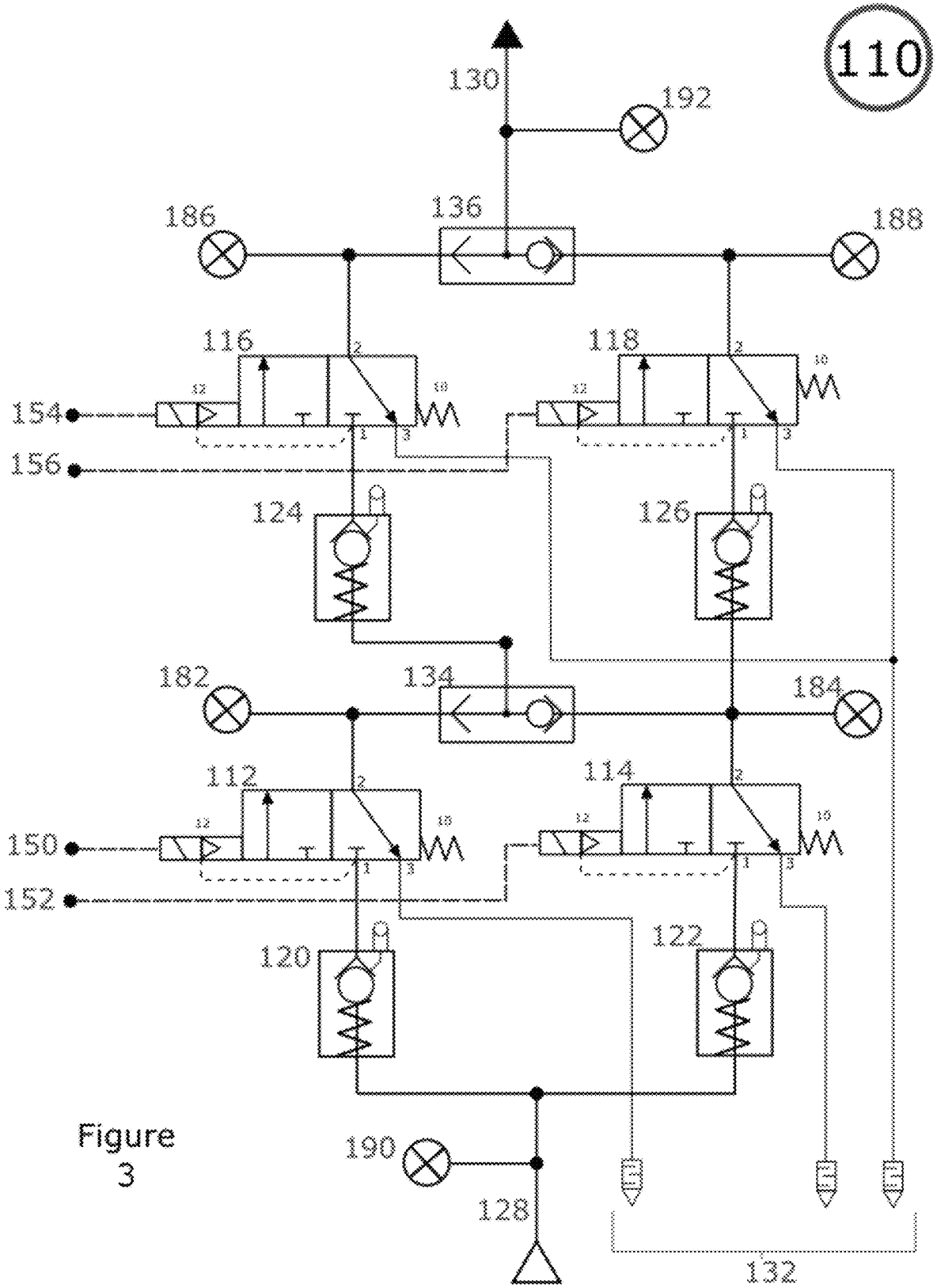
FIG. 3 illustrates a circuit diagram of a redundant valve manifold (RVM) system operating with a three out of four (3oo4) function.

FIG. 3 illustrates a circuit diagram of a RVM system 110 used in a processing and manufacturing industry operating with a 3oo4 function. The RVM system 110 can use the same unit as the RVM system 10. The components of the RVM system 110 are the same as the RVM system 10, except like components are labeled with the addition of 100. In this example, the RVM system 110 receives four input signals 150, 152, 154, and 156, and each automatic valves 112, 114, 116, and 118 operates independently of each other. In one example, the four input signals 150, 152, 154, and 156 are electrical. In one example, the automatic valve 112 receives the input signal 150, the automatic valve 114 receives the input signal 152, the automatic valve 116 receives the input signal 154, and the automatic valve 118 receives the input signal 156. Three out of the four input signals 150, 152, 154, and 156 are required to maintain an output at the outlet 30. If three out of the four input signals 50, 52, and 54 are de-energized, the output at the outlet 30 is prevented.

An automatic isolation valve 120, 122, 124, and 126 is coupled to each of the automatic valves 112, 114, 116, 118, respectively, to allow the automatic valves 112, 114, 116, 118 to be hot swapped.

In one example, the RVM system 110 includes indicators 182, 184, 186, and 188 that indicate if any of the automatic valves 112, 114, 116, and 118, respectively, have failed and allow for diagnosis of an error. In one example, the indicators 182, 184, 186, and 188 are visual indicators. In an example, the indicators 182, 184, 186, and 188 are pressure sensors or pressure switches.

The RVM system 110 could also include pressure switches or other types of sensors to indicate a fault or error. The inlet 128 is associated with an indicator 190, and the outlet 130 is associated with an indicator 192.

When all the automatic valves 112, 114, 116, and 118 are in the energized state, the media is able to flow through the RVM system 110 and to the outlet 130. When all the automatic valves 112, 114, 116, and 118 are in the de-energized state, the media is unable to flow through the RVM system 110 to the outlet 130, and some of the media flows to the exhaust 132.

If one of the automatic valves 112, 114, 116, and 118 fail, the RVM system 110 will continue to function to produce an output at the outlet 130. Except for the fourth input signal 156, the RVM system 110 of FIG. 3 operating with a 3oo4 function operates in a similar manner to the RVM system 10 of FIG. 1 operating with a 2oo3 function.

In one example of a single valve failure, the automatic valve 112 is de-energized, and the automatic valves 114, 116, and 118 are energized. The media passes through the energized automatic valve 114, the first shuttle valve 134, the energized automatic valves 116 and 118, and flows through the outlet 130. The indicators 184, 186 and 188 indicate availability, and the indicator 182 indicates unavailability. The automatic valve 112 is removed, and the automatic isolation valve 120 associated with the automatic valve 112 is automatically activated by the removal of the automatic valve 112 to perform hot swapping. During this time, the automatic valves 114, 116, and 118 of the RVM system 110 continue to function to produce an output at the outlet 130.

In another example of a single valve failure, the automatic valve 116 is de-energized, and the automatic valves 112, 114 and 118 are energized. The media passes through the energized automatic valves 112 and 114, the first shuttle valve 134, the automatic valve 118, the second shuttle valve 136, and flows through the outlet 130. The indicators 182, 184, 188 indicate availability, and the indicator 186 indicates unavailability. The automatic valve 116 is removed, and the automatic isolation valve 124 associated with the automatic valve 116 is automatically activated by the removal of the automatic valve 116 to perform hot swapping. During this time, the automatic valves 112, 114, and 118 of the RVM system 110 continue to function to produce an output at the outlet 130.

In another example of a single valve failure, the automatic valve 118 is de-energized, and the automatic valves 112, 114, and 116 are energized. The media passes through the automatic valves 112 and 114, the first shuttle valve 134, the automatic valve 116, and the second shuttle valve 136, and flows through the outlet 130. The indicators 182, 184, 186 indicate availability, and the indicator 188 indicates unavailability. The automatic valve 118 is removed, and the automatic isolation valve 26 associated with the automatic valve 118 is automatically activated by the removal of the automatic valve 118 to perform hot swapping. During this time, the automatic valves 112, 114, and 116 of the RVM system 110 continue to function to produce an output at the outlet 130.

In another example, the solenoid valve 114 is de-energized, and the solenoid valves 112, 116, and 118 are energized. The media passes through the energized automatic valve 112, the first shuttle valve 134, the energized automatic valve 116, the second shuttle valve 136, and flows through the outlet 130. The indicators 182 and 186 indicate availability, and the indicators 184 and 188 indicate unavailability. The automatic valve 114 is removed, and the automatic isolation valve 122 associated with the automatic valve 114 is automatically activated by the removal of the automatic valve 114 to perform hot swapping. During this time, the automatic valves 112 and 116 of the RVM system 110 continue to function to produce an output at the outlet 130. Although the automatic valve 118 is not faulty, the automatic valve 118 does not function due to the absence of a media supply from the automatic valve 114.

In an example of a two valve failure, the automatic valves 112 and 116 are de-energized, and the automatic valves 114 and 118 are energized. The media passes through the energized automatic valves 114 and 118, the second shuttle valve 136, and flows through the outlet 130. The indicators 184 and 188 indicate availability, and indicators 182 and 186 indicate unavailability. The automatic valves 112 and 116 are removed, and the automatic isolation valves 120 and 124, respectively, associated with the automatic valves 112 and 116 are automatically activated by the removal of the automatic valves 112 and 116 to perform hot swapping. During this time, the RVM system 110 continues to function to produce an output at the outlet 130.

In another example of a two valve failure, the automatic valves 114 and 118 are de-energized, and the automatic valves 112 and 116 are energized. The media passes through the energized automatic valve 112, the first shuttle valve 134, the energized automatic valve 116, the second shuttle valve 136, and flows through the outlet 130. The indicators 182 and 186 indicate availability, and the indicators 184 and 188 indicate unavailability. The automatic valves 114 and 118 are removed, and the automatic isolation valves 122 and 126, respectively, associated with the automatic valves 114 and 118 are automatically activated by the removal of the automatic valves 114 and 118 to perform hot swapping. During this time, the RVM system 110 continues to function to produce an output at the outlet 130.

In another example of a two valve failure, the automatic valves 112 and 118 are de-energized, and the automatic valves 114 and 116 are energized. The media passes through the automatic valve 114, the first shuttle valve 134, the automatic valve 116, the second shuttle valve 136, and flows through the outlet 130. The indicators 184 and 186 indicate availability, and the indicators 182 and 188 indicate unavailability. The automatic valves 112 and 118 are removed, and the automatic isolation valves 120 and 26, respectively, associated with the automatic valves 112 and 118 are automatically activated by the removal of the automatic valves 112 and 118 to perform hot swapping. During this time, the RVM system 110 continues to function to produce an output at the outlet 130.

In some examples of a two valve failure or if there is a three valve failure, media is unable to flow through the outlet 130. This can occur when the automatic valve 112 is energized and the automatic valves 114, 116, and 118 are de-energized, the automatic valve 114 is energized and the automatic valves 112, 116, and 118 are de-energized, the automatic valve 116 is energized and the automatic valves 112, 114, and 118 are de-energized, and the automatic valve 118 is energized and the automatic valves 112, 114, and 116 are de-energized. This can also occur when the automatic valves 112 and 114 are energized the automatic valves 116 and 118 are de-energized, the automatic valves 116 and 118 are energized and the automatic valves 112 and 114 are de-energized, and the automatic valves 114 and 116 are de-energized, and the automatic valves 112 and 118 are energized.

Figure 4:
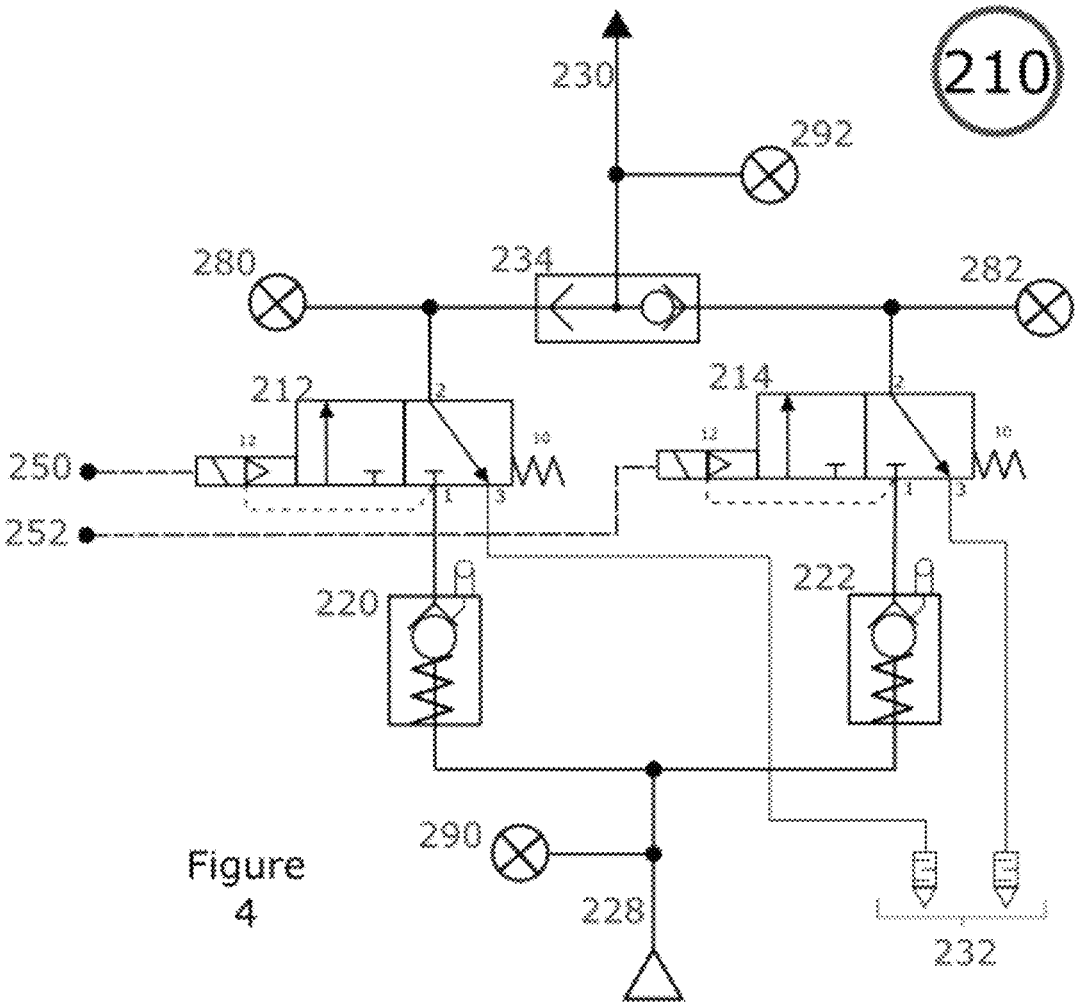
FIG. 4 illustrates a circuit diagram of an increased availability manifold (IAM) system operating with a two out of two de-energized to trip (2oo2 DETT) function or a one out of two energized to trip (1oo2 ETT) function.

FIG. 4 illustrates a circuit diagram of an increased availability manifold (IAM) system 210 used in a processing and manufacturing industry operating with a two out of two de-energized to trip (2oo2 DETT) function or a one out of two energized to trip (1oo2 ETT) function. The components of the IAM system 210 are the same as the RVM systems 10 and 110, except like components are labeled with the addition of 200.

In one example, both the automatic valves 212 and 214 receive the same input signal 250, creating a mechanical redundancy. Both automatic valves 212 and 214 must be de-energized to close an output at the outlet 230. An automatic isolation valve 220 and 222 is coupled to each of the automatic valves 212 and 214, respectively, to allow the automatic valves 212 and 214 to be hot swapped. In another example shown in FIG. 4, the IAM system 210 receives two input signals 250 and 252, and each automatic valve 212 and 214 operates independently of the other. In this example, the automatic valve 212 receives the input signal 250, and the automatic valve 214 receives the input signal 252.

In one example, the IAM system 210 includes indicators 280 and 282 that indicate if any of the automatic valves 212 and 214, respectively, have failed and allow for diagnosis of an error. In one example, the indicators 282 and 284 are visual indicators. In another example, the indicators 282 and 284 are pressure sensors or pressure switches. The IAM system 210 could also include pressure switches or other types of sensors to indicate a fault or error. The inlet 228 is associated with an indicator 290, and the outlet 230 is associated with an indicator 292.

When both of the automatic valves 212 and 214 are in the energized state, media is able to flow through the IAM system 210 and to the outlet 230. When both of the automatic valves 212 and 214 are in the de-energized state, media is unable to flow through the IAM system 210 to the outlet 210, and some of the media flows to the exhaust 232.

If one of the automatic valves 212 and 214 fails, the IAM system 210 will continue to function to produce an output at the outlet 230.

In one example of a single valve failure, the automatic valve 212 is de-energized, and the automatic valve 214 is energized. The media passes through the energized automatic valve 214, the first shuttle valve 234, and flows through the outlet 230. The indicator 282 indicates availability, and the indicator 280 indicates unavailability. The automatic valve 212 is removed, and the automatic isolation valve 220 associated with the automatic valve 212 is automatically activated by the removal of the automatic valve 212 to perform hot swapping. During this time, the automatic valve 214 of the IAM system 210 continues to function to produce an output at the outlet 230.

In another example of a single valve failure, the automatic valve 214 is de-energized, and the automatic valve 212 is energized. The media passes through the energized automatic valve 212, the first shuttle valve 234, and flows through the outlet 230. The indicator 280 indicates availability, and the indicator 282 indicates unavailability. The automatic valve 214 is removed, and the automatic isolation valve 222 associated with the automatic valve 214 is automatically activated by the removal of the automatic valve 214 to perform hot swapping. During this time, the automatic valve 212 of the IAM system 210 continues to function to produce an output at the outlet 230.

Figure 5:
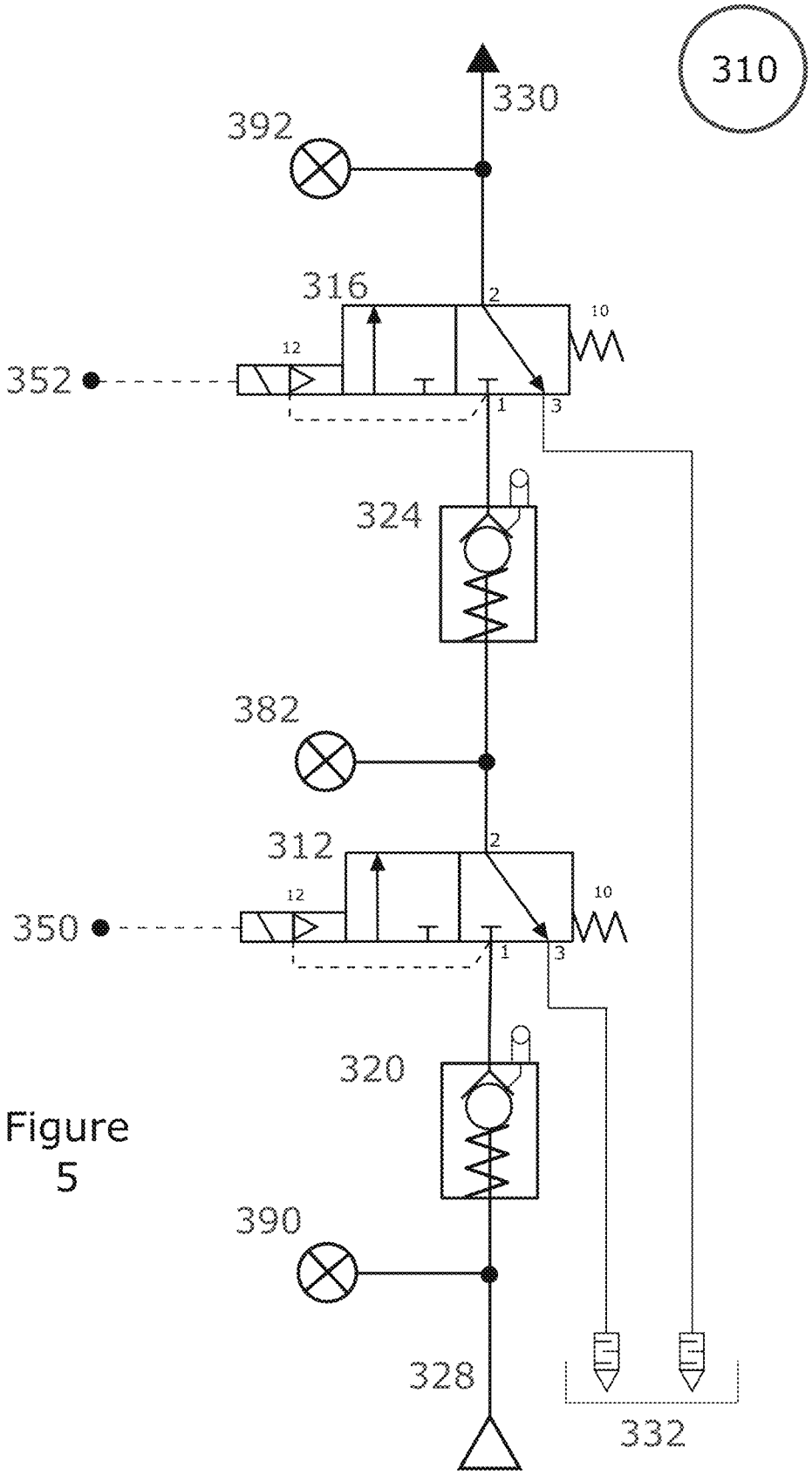
FIG. 5 illustrates a circuit diagram of an increased safety manifold (ISM) system operating with a one out of two de-energized to trip (1oo2 DETT) function or a two out of two energized to trip (2oo2 ETT) function.

FIG. 5 illustrates a circuit diagram of an increased safety manifold (ISM) system 310 used in a processing and manufacturing industry operating with a one out of two de-energized to trip (1oo2 DETT) function or a two out of two energized to trip (2oo2 ETT) function. The components of the ISM system 310 are the same as the RVM systems 10 and 110 and the IAM system 210, except like components are labeled with the addition of 300.

The automatic valve 312 receives the input signal 350, and the automatic valve 316 receives the input signal 352. The automatic valves 312 and 316 are connected in a series configuration. The output of the automatic valve 312 is the sole input of the automatic valve 316. An automatic isolation valve 320 and 324 is coupled to each of the automatic valves 312 and 316, respectively, to allow the automatic valves 312 and 316 to be hot swapped. In another example, both the automatic valves 312 and 316 receive the same input signal 350 or 352, creating a mechanical redundancy In one example, the ISM system 310 includes indicators 382 and 392 that indicate if either the automatic valves 312 and 316, respectively, have failed and allow for diagnosis of an error. In one example, the indicators 382, 390 (discussed below), and 392 are visual indicators. In another example, the indicators 382, 390, and 392 are pressure sensors or pressure switches. The ISM system 310 could also include pressure switches or other types of sensors to indicate a fault or error. The inlet 328 is associated with an indicator 390, and the outlet 330 is associated with an indicator 392.

When both of the automatic valves 312 and 316 are in the energized state, media is able to flow through the ISM system 310 to the outlet 330. When one or both of the automatic valves 312 and 316 are in the de-energized state, media is unable to flow through the ISM system 310 to the outlet 330, and some of the downstream pressure is vented to the exhaust 332.

In one example of a single valve failure, the automatic valve 312 is de-energized, and the automatic valve 316 is energized. The indicators 382 and 392 indicate unavailability. The automatic valve 312 is removed, and the automatic isolation valve 320 associated with the automatic valve 312 is automatically activated by the removal of the automatic valve 312 to perform the replacement of the automatic valve 312. Further diagnostic trouble shooting is employed to confirm that the automatic valve 312 is de-energized before the automatic valve 312 is replaced.

In another example of a single valve failure, the automatic valve 316 is de-energized, and the automatic valve 312 is energized. The indicator 392 indicates unavailability. The automatic valve 316 is removed, and the automatic isolation valve 324 associated with the automatic valve 316 is automatically activated by the removal of the automatic valve 316 to perform the replacement of the automatic valve 316.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A redundant valve manifold system comprising:

at least two automatic valves coupled to one another; and at least two automatic isolation valves each corresponding to one of the at least two automatic valves, wherein each of at least two automatic isolation valves is operatively coupled to one of the at least two automatic valves and isolates the one of the at least two automatic valves when the one of the at least two automatic valves is removed from the system to deliver media to an outlet, wherein the automatic valves are connected in a series configuration, and an output of the first automatic valve is a sole input of the second automatic valve, wherein one of the at least two automatic valves or one of the at least two automatic isolation valves includes a pin including a pin opening, the pin defining a pin fluid passage in fluid communication with the pin opening and that is received in a valve seat passage of a valve seat, and the other of the one of the at least two automatic valves or the one of the at least two automatic isolation valves includes a ball and a resilient member that are received in a ball fluid passage that is in fluid communication with the pin fluid passage, wherein when the one of the at least two automatic valves is installed in the system, the pin contacts the ball to compress the resilient member and push the ball away from the valve seat, and the pin fluid passage and the pin openings are in fluid communication with the valve fluid passage to allow the media to flow through the valve fluid passage, the pin opening in the pin, and the pin fluid passage of the pin.

2. The redundant valve manifold system as recited in claim 1, wherein if one of the at least two automatic valves fails and is removed from the system, the associated one of the automatic isolation valves automatically actuates, and as the pin is removed from the valve seat passage of the valve seat, the resilient member biases the ball towards the valve seat, blocking the flow of the media through the valve seat passage to isolate the one of the at least two automatic valves from service to allow for replacement.

3. The redundant valve manifold system as recited in claim 1, including at least two indicators each associated with one of the at least two automatic valves, wherein each of the at least two indicators indicate if the associated automatic valve has failed.

4. The redundant valve manifold system as recited in claim 3, wherein each of the at least two indicators are visual indicators.

5. The redundant valve manifold system as recited in claim 3, wherein each of the at least two indicators are pressure sensors or pressure switches.

6. The redundant valve manifold system as recited in claim 3, including another indicator and yet another indicator, wherein an inlet is associated with the another indicator, and the outlet is associated with the yet another indicator.

7. The redundant valve manifold system as recited in claim 1, including a first shuttle valve associated with one of the at least two automatic valves and the outlet.

8. The redundant valve manifold system as recited in claim 7, including a second shuttle valve associated with the other of at least two automatic valves.

9. The redundant valve manifold system as recited in claim 1, wherein when the at least two automatic valves are in the energized state, the media is able to flow through the system and to the outlet, and when all the at least two automatic valves are in the de-energized state, the media is unable to flow through the system and to the outlet, and some of the media flows to an exhaust.

10. The redundant valve manifold system as recited in claim 1, wherein the at least two automatic valves comprise a first automatic valve, a second automatic valve, a third automatic valve, and a fourth automatic valve that can each be in an energized state or a de-energized state, and the at least two automatic isolation valves comprise a first automatic isolation valve, a second automatic isolation valve, a third automatic isolation valve, and a fourth automatic isolation valve, respectively.

11. The redundant valve manifold system as recited in claim 10, wherein the system receives three input signals comprising a first input signal, a second input signal, and a third input signal, wherein the first automatic valve and the second automatic valve together receive the first input signal, the third automatic valve receives the second input signal, and the fourth automatic valve receives the third input signal, wherein two out of the three input signals are required to maintain an output at the outlet.

12. The redundant valve manifold system as recited in claim 10, wherein the system receives four input signals comprising a first input signal, a second input signal, a third input signal, and a fourth input signal, wherein the first automatic valve receives the first input signal, the second automatic valve receives the second input signal, the third automatic valve receives the third input signal, and the fourth automatic valve receives the fourth input signal, and three out of the four input signals are required to maintain an output at the outlet.

13. The redundant valve manifold system as recited in claim 1, wherein the at least two automatic valves comprise a first automatic valve and a second automatic valve that can each be in an energized state or a de-energized state, and the at least two automatic isolation valves comprise a first automatic isolation valve and a second automatic isolation valve, respectively.

14. The redundant valve manifold system as recited in claim 13, wherein the system receives two input signals comprising a first input signal and a second input signal, wherein the first automatic valve receives the first input signal and the second automatic valve receives the second input signal, and two out of two input signals are required to maintain an output at the outlet.

15. The redundant valve manifold system as recited in claim 13, wherein the system receives two input signals comprising a first input signal and a second input signal, wherein the first automatic valve receives the first input signal and the second automatic valve receives the second input signal, and one out of two input signals are required to maintain an output at the outlet.

16. A redundant valve manifold system comprising:

at least two automatic valves coupled to one another;

at least two automatic isolation valves each corresponding to one of the at least two automatic valves, wherein each of at least two automatic isolation valves is operatively coupled to one of the at least two automatic valves and isolates the one of the at least two automatic valves when the one of the at least two automatic valves is removed from the system to deliver media to an outlet;

a first shuttle valve associated with one of the at least two automatic valves and the outlet and a second shuttle valve associated with the other of at least two automatic valves; and at least two visual indicators, another visual indicator, and yet another visual indicator, wherein each of the at least two visual indicators is associated with one of the at least two automatic valves, each of the at least two visual indicators indicate if the associated automatic valve has failed, an inlet is associated with the another visual indicator, and the outlet is associated with the yet another visual indicator, wherein one of the at least two automatic valves or one of the at least two automatic isolation valves includes a pin including a pin opening, the pin defining a pin fluid passage in fluid communication with the pin opening and that is received in a valve seat passage of a valve seat, and the other of the one of the at least two automatic valves or the one of the at least two automatic isolation valves includes a ball and a resilient member that are received in a ball fluid passage that is in fluid communication with the pin fluid passage, wherein when the one of the at least two automatic valves is installed in the system, the pin contacts the ball to compress the resilient member and push the ball away from the valve seat, and the pin fluid passage and the pin openings are in fluid communication with the valve fluid passage to allow the media to flow through the valve fluid passage, the pin openings in the pin, and the pin fluid passage of the pin, wherein if one of the at least two automatic valves fails and is removed from the system, the associated one of the automatic isolation valves automatically actuates, and as the pin is removed from the valve seat passage of the valve seat, the resilient member biases the ball towards the valve seat, blocking the flow of the media through the valve seat passage to isolate the one of the at least two automatic valves from service to allow for replacement, and wherein the automatic valves are connected in a series configuration, and an output of the first automatic valve is a sole input of the second automatic valve.

* * * * *